US006443770B1

(12) United States Patent
Lin

(10) Patent No.: US 6,443,770 B1
(45) Date of Patent: Sep. 3, 2002

(54) ANTI INTERFERENCE PLUG STRUCTURE

(76) Inventor: Shien-Chang Lin, P.O. Box No. 6-57, Chung-Ho, Taipei 235 (TW)

( * ) Notice: Subject to any disclaimer, the term of this patent is extended or adjusted under 35 U.S.C. 154(b) by 0 days.

(21) Appl. No.: 09/953,299

(22) Filed: Sep. 17, 2001

(51) Int. Cl.[7] ..... H01R 13/66; H01R 33/945; H01R 11/30; H01R 13/60

(52) U.S. Cl. ..... 439/620; 439/38

(58) Field of Search ..... 439/620, 38

(56) References Cited

U.S. PATENT DOCUMENTS 2,483,815 A * 10/1949 Easton ..... 175/356
3,784,950 A * 1/1974 Coffman ..... 338/220
3,988,639 A * 10/1976 Preiser et al. ..... 317/9
4,329,665 A * 5/1982 Kawai et al. ..... 333/182
5,034,846 A * 7/1991 Hodge et al. ..... 361/119
5,088,835 A * 2/1992 Shigezawa et al. ..... 374/181
5,088,939 A * 2/1992 Shepherd ..... 439/620
5,118,308 A * 6/1992 Liu et al. ..... 439/620
5,240,436 A * 8/1993 Bradley et al. ..... 439/645
5,385,476 A * 1/1995 Jasper ..... 439/38
5,626,479 A * 5/1997 Hughes ..... 439/35
5,872,492 A * 2/1999 Boutros ..... 333/182
6,109,971 A * 8/2000 Vadlakonda ..... 439/620
6,252,163 B1 * 6/2001 Fujimori et al. ..... 174/36
6,267,602 B1 * 7/2001 Mendelson et al. ..... 439/39
6,267,626 B1 * 7/2001 Hollander et al. ..... 439/620

* cited by examiner

*Primary Examiner*—P. Austin Bradley
*Assistant Examiner*—Edwin A. León
(74) *Attorney, Agent, or Firm*—Troxell Law Ofice PLLC

(57) ABSTRACT

The present invention relates to an anti interference plug structure, which includes a one-piece plug and electric connection cable for linking to electric signal source. A magnetic core component is connected at an appropriate position of the electric cable, inside of which is established a plurality of winding channels along equal axial isolated parallels, which allow the electric cord conducting wire to make internal parallel windings, and lengthen the conducting wire coil route thereby improving the results of electric cable anti demagnetization interference several-fold.

3 Claims, 5 Drawing Sheets

ANTI INTERFERENCE PLUG STRUCTURE

BACKGROUND OF THE INVENTION

1. Field of the Invention

This present invention is related to the structure of an anti interference plug, and specifically a type of electric signal. connector and anti interference plug structures which internally contain a plurality of matching wrapped channels.

2. Description of the Prior Art

Electric signal connectors are widely used to link electric signals, such as the link between the signal source and electric or electronic equipment in order to enable the signal source to directly provide the needed signals to such equipment. Therefore it is a necessity that a connection signal flow free of obstruction can be maintained between the signal source and the electric/electronic equipment. However because the electric signal transmission route between the electric signal plug and signal source is necessary long, in actual situations where electric signal plugs are applied as connectors between the signal source and electric/electronic equipment we often see a situation where interference from the signal source itself or the electric cable route affects the signal. This interference resulting in problems where incorrect or damaged electronic signals are created during transmission to the electric equipment.

FIGS. 7–9 show the traditional anti interference structure used in electric signal plug in order to solve the problem with interference during transmissions to the electric or electronic equipment. As shown in FIGS. 7 and 8, wherein on top of electric cables B and B' back from electric signal plugs A and A', there is anti interference steel core C in string connection respectively, which reduces static and interference waves existing in electric cables B and B'. FIG. 9 shows the internal structure of electric cable B passing through anti interference steel core C (the way that cable B' passes though is the same). The interior of this anti interference steel core C contains a twisting passageway (C1), which is provided so that electric cable B can repeatedly twist in and out of steel core C.

As shown in FIG. 9, there are several twists that allow electric cable B to repeatedly twist through passageway C1, causing the electric signal to go in and out of the same area twice in the same route and direction, as the arrowhead marks the direction in the first route C2, second route C3, and third route C4 as shown in FIG. 14. Moreover the first route C2 and third route C4 have overlapping effective magnetic fields created by the electric current contents in the electric signal. The length of this effective route is the length of the first route C2 plus the second route C3.

However, the anti interference results created by anti interference steel core C are in direct proportion to the length of the routes of the effective conductor passing through anti interference steel core C. As far as the above described anti interference steel core C is concerned, it doesn't matter how many times electric cable B passes through anti interference steel core C, the length of the effective conductor will forever equal the length of first route C2 plus the length of second route C3, thus leading to the inability for any breakthrough efficiency improvement in anti interference steel core C.

SUMMARY OF THE INVENTION

The primary objective of the present invention is to provide an anti interference plug structure, which internally contains a plurality of equal axial parallel winding channels that can be used to wind the electric cable therein and correspondingly increase effective conduction length as well as anti interference efficiency.

Another objective of the present invention is to provide an anti interference plug structure that makes it possible to simply and directly set and adjust the level and degree of interference in the conducting wire according to the numbers and levels of conductor coils in order to meet the circuit interference demands of different electric or electronic equipment.

In order to accomplish the above described objective, the anti interference plug structure of this invention includes one plug, one end connector with one electric cord to connect to the electric signal source, and one magnetic core component that is located at a proper location on the connector. Inside of this magnetic core is established a plurality of winding channels along equal axial isolated parallels, which allow the electric cord conducting wire to make parallel winding within, and lengthen the conducting wire coil route thereby improving the results of electric cable anti demagnetization interference by several-fold.

The details of the structure and application of the present invention will be made clear by the details in the explanation to follow. At the same time an elaboration of the structure are presented in the detailed description of the preferred embodiments below and preceded by the brief description of the drawings to provide a further understanding of technological content of the invention herein.

DETAILED DESCRIPTION OF THE PREFERRED EMBODIMENTS

Figure 1:
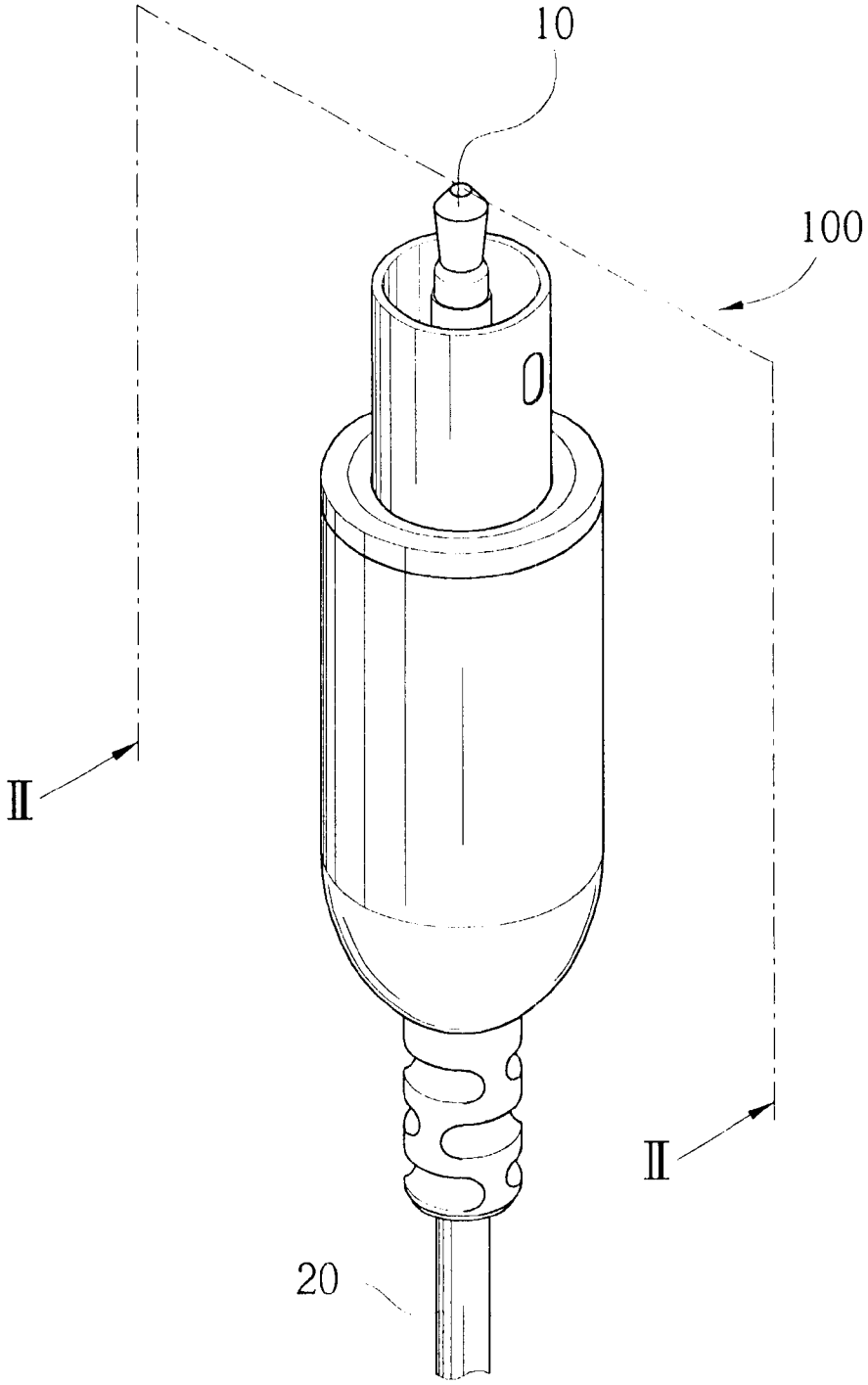
FIG. 1 is a perspective view of the present invention's external structure.
Figure 2:
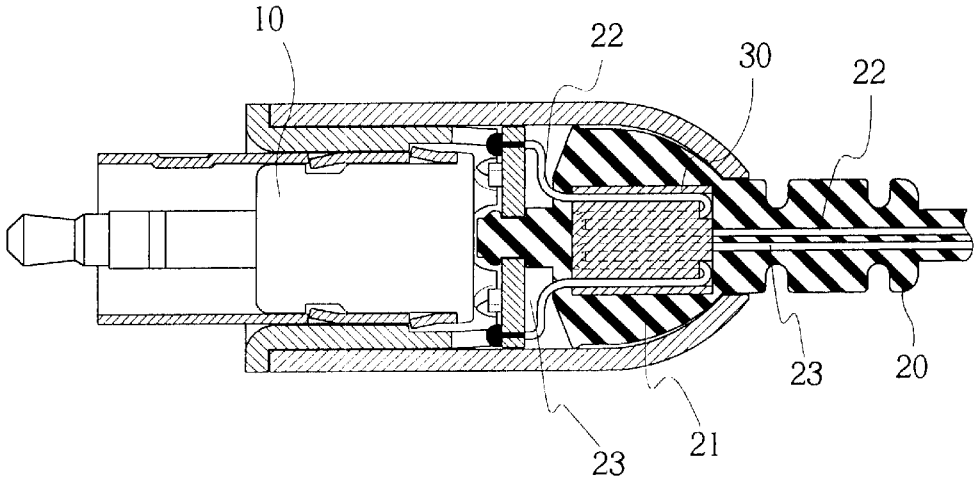
FIG. 2 is an A—A cross-sectional view of the present invention, revealing the structure of the magnetic core inside the insulation encasement.
Figure 3:
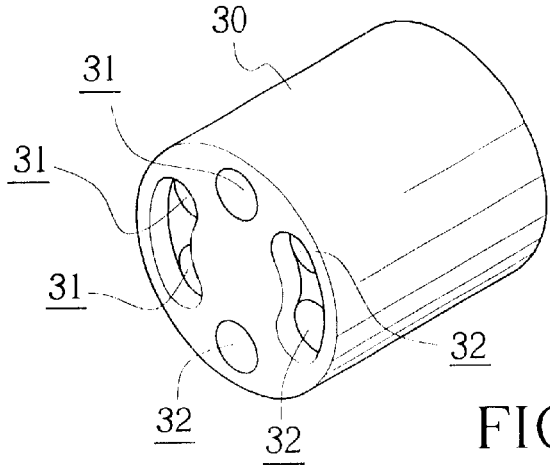
FIG. 3 is a perspective view of the magnetic core component.
Figure 4:
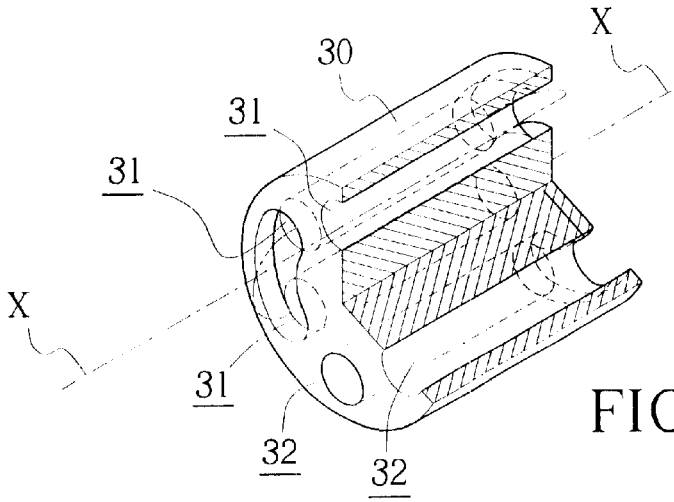
FIG. 4 is a perspective partial cross-sectional view showing the structure of the winding channels inside the magnetic core of the present invention.

First referring to FIGS. 1 through 4 and notice that the present invention is displayed as unit 100. However, anti interference plug 100 is not limited in shape or form. The present invention uses a model with direct power source connection for all examples. Anti interference plug 100 includes a plug 10 on one end that connects to an electric cable 20 for the purpose of linking to the electric signal source. All examples made in the present invention use direct current supply equipment that include an insulation encasement 21 at the end of the electric line 20 (as shown in FIG. 1) to act as a bridge between the plug 10.

The magnet core component is linked at a proper location on the electric cord 20 and is buried within the encasement 21 (see FIG. 2), inside of which is located wrapped channels 31 and 32 that move on a straight line next to axis X and maintain a parallel isolated status from each other (see FIG. 4) that are arranged in sort of a beehive structure. This arrangement is the only part of this model that there is no set limits established for, while all other arrangements included in these designs are inclusive to this invention.

Figure 5:
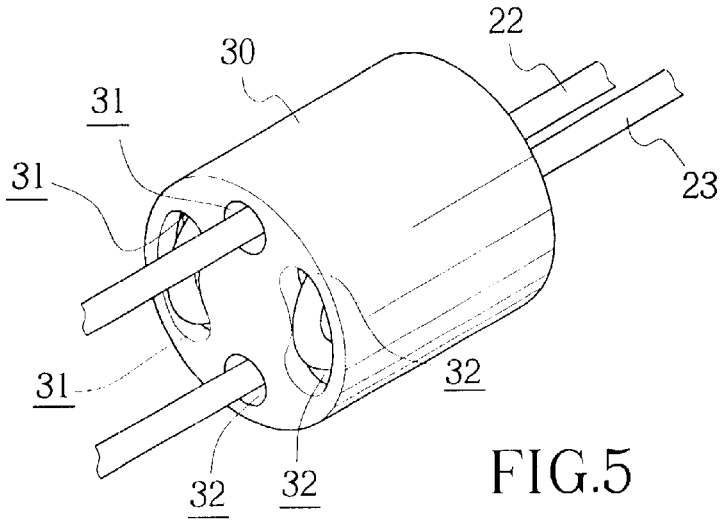
FIG. 5 is a perspective view version of FIG. 2, revealing the state of the coiling conduction lines inside the magnetic core component of the present invention.
Figure 6:
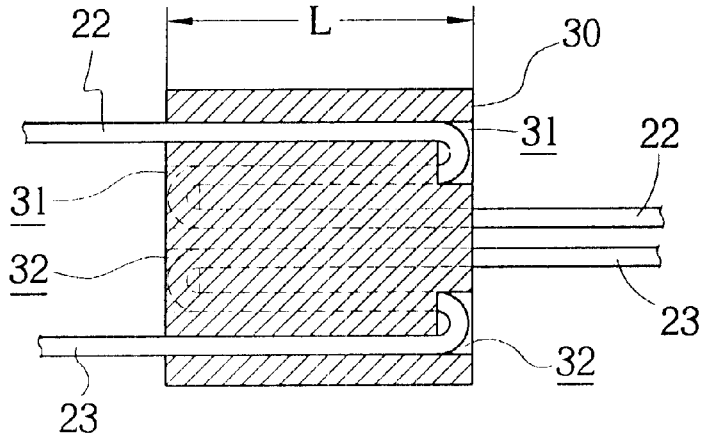
FIG. 6 is a cross-sectional view of FIG. 4, showing the parallel winding structure of each coil channel inside the magnet core component.
Figure 9:
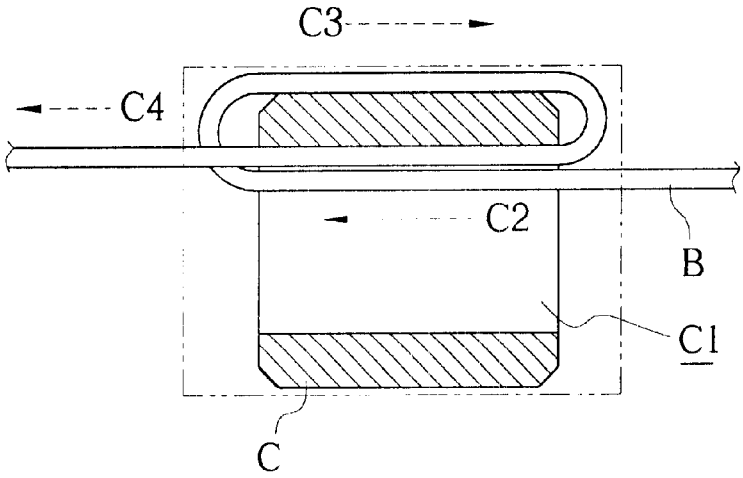
FIG.9 PRIOR ART
FIG. 9 is a cross-sectional view showing the condition of the electrical line wrapping in and out of the conventional anti interference component.
Figure 7:
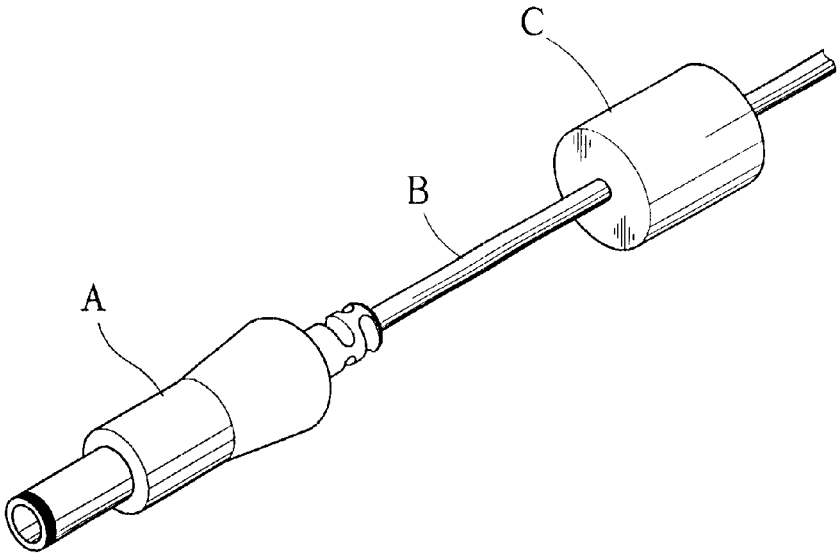
FIG.7 PRIOR ART
FIG. 7 is a perspective external structural view of a conventional electric signal plug containing the anti interference component.
Figure 8:
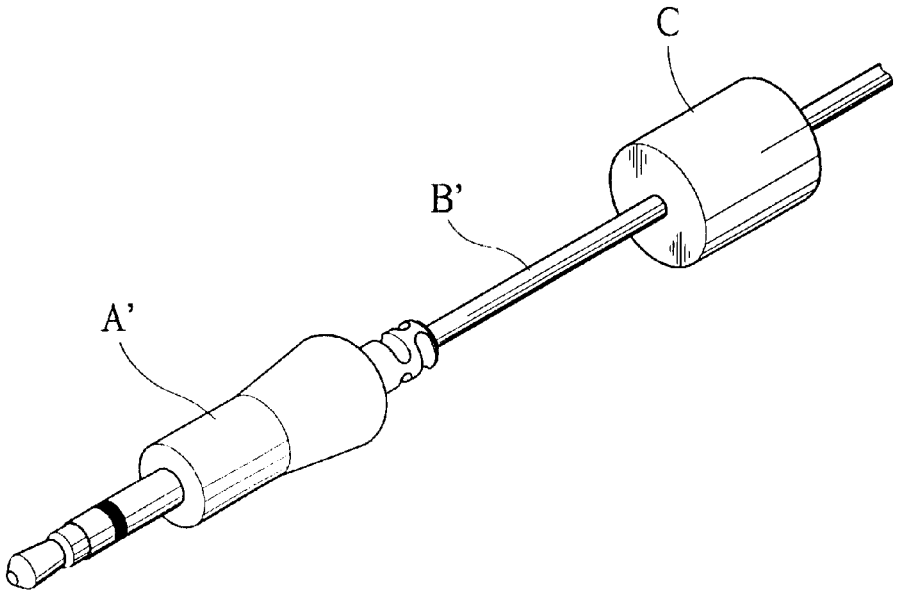
FIG.8 PRIOR ART
FIG. 8 is a perspective external structural view of another conventional electric signal plug containing the anti interference component.

Please harmonize with FIGS. 5 and 6, which show the winding circumstances of conductor lines 22 and 23 through the magnetic core component winding channels inside of the electric cable 20, as well as the reciprocating parallel isolated structure and paths of each of the winding channels 31 & 32 that the conductor lines 22 & 23 are led through forming repeated winding forward and backward direction conditions (as shown in FIG. 6). The present invention includes examples showing three repeated windings where conductor lines 22 and 23 pass through the magnetic core component three times in equal parallel isolated windings. This causes the total effective conductivity length of individual winding channels 31 and 32 that are passed through by electric signal circulating conductor lines 22 and 23 to equal 3 times the length of the magnetic core (L), which thereby increases total anti interference results 1.5 times (as shown in FIGS. 7–9). Of course, theoretically then by increasing the number of winding channels 31 and 32 we can correspondingly cause an increase in the layers of curves that conductor lines 22 and 23 make though the magnetic core component and thereby effectively increase anti interference results several fold and adjust the anti interference structure to meet the different anti interference needs of different electric or electronic equipment.

Therefore, as explained by FIGS. 1–6, the present invention now enables us to increase or establish the anti interference results of electric cable 20 by changing and adjusting the length of curves made through the magnetic core component. All structural changes or embellishments made according to this principle are encompassed by the scope of the present invention.

Moreover, according to the detailed structure, capabilities, and operation of the present anti interference plug invention explained within FIGS. 1–6 above, we find the following advantages, practical uses, and valuable industrial application conclusions:

1. Possesses the capability to increase anti interference efficiency by several times. By utilizing the parallel isolated winding channels 31 and 32 inside of magnetic core component 30 we can greatly increase the effective length of the curving conductor lines 22 and 23 that make up electric cord 20, thereby increasing the results of anti interference.
2. We can adjust the degree of anti interference at will to meet different electric/electrical equipment anti interference needs. Therefore, adjusting the number of winding channels 31 and 32 within magnetic core component 30 we are able to adjust anti interference results to harmonize with each different type of electric/electronic equipment.

The essence of the present anti interference plug 100 invention is to increase anti interference results inside of electric signal lines through the simplest means necessary, becoming a valuable and useful invention to industry. The anti interference plug structure of the present invention as shown in FIGS. 1–6, including all related explanations, content, and diagrams, are for the purpose of explaining the technology and means used by the present invention.

Moreover the present invention is not limited to the practical application example contained therein, but all structural embellishments and/or component replacements in relation to the present invention are included within the parameters and essence of the present invention, which parameters shall be established by the following patent parameters.

What is claimed is:

1. An anti-interference plug assembly comprising:

(a) a plug housing having an interior;

(b) an electric cable having at least two conductor lines, ends of the at least two conductor lines located in the interior of the plug housing; and (c) a magnetic core component located in the interior of the plug housing and having a cylindrical configuration with a plurality of parallel, spaced apart channels extending therethrough, each of the at least two conductor lines entering one of the plurality of channels through a first end of the magnetic core component and passing through at least two adjacent channels before exiting through a second, opposite end of the magnetic core component.

2. The anti-interference plug assembly of claim 1 further comprising a plurality of recesses in each first and second end of the magnetic core component, each recess communicating with two adjacent, spaced apart channels.

3. The anti-interference plug assembly of claim 1 further comprising an insulation encasement within the plug housing encasing the magnetic core component.

* * * * *